US008475150B2

(12) United States Patent
Kaeferstein et al.

(10) Patent No.: US 8,475,150 B2
(45) Date of Patent: Jul. 2, 2013

(54) INTERNAL GEAR PUMP FOR A BRAKE SYSTEM

(75) Inventors: Berthold Kaeferstein, Moeckmuchl (DE); Rene Schepp, Waiblingen (DE); Tilman Noack, Ilsfeld-Auenstein (DE); Norbert Alaze, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 378 days.

(21) Appl. No.: 12/738,459

(22) PCT Filed: Sep. 19, 2008

(86) PCT No.: PCT/EP2008/062563

§ 371 (c)(1),
(2), (4) Date: May 25, 2010

(87) PCT Pub. No.: WO2009/049991

PCT Pub. Date: Apr. 23, 2009

(65) Prior Publication Data

US 2010/0247363 A1 Sep. 30, 2010

(30) Foreign Application Priority Data

Oct. 17, 2007 (DE) ..... 10 2007 049 704

(51) Int. Cl.
*F04C 2/10* (2006.01)

(52) U.S. Cl.
USPC ..... 418/170; 123/152; 123/153

(58) Field of Classification Search
USPC ..... 418/170, 179, 152, 153, 156
See application file for complete search history.

(56) References Cited

U.S. PATENT DOCUMENTS 2,875,700 A * 3/1959 Hardy ..... 418/126
3,486,459 A * 12/1969 Eltze ..... 418/126

* cited by examiner

*Primary Examiner* — Zelalem Eshete
(74) *Attorney, Agent, or Firm* — Maginot, Moore & Beck

(57) ABSTRACT

The invention relates to an internal gear pump for a brake system, in the pump housing of which an internally toothed ring gear and a pinion meshing with the toothing of the ring gear are pivotally supported about parallel axes. As a result the toothing thereof limits an approximately crescent-shaped tapering annular space, in which a filler piece supported toward the intake side of the pump is arranged. The circumferential sides of the filler piece are bent in accordance with the addendum circle of the ring gear toothing or of the pinion toothing. The sides rest against several tooth tips in a sealing manner under a spring force. According to the invention, one of the two circumferential sides of the filler piece is formed by a radially resilient circumferential wall, which is nestled against the tooth tips of the pinion or the ring gear due to the deflection based on the inherent spring force thereof.

10 Claims, 2 Drawing Sheets

Fig. 1
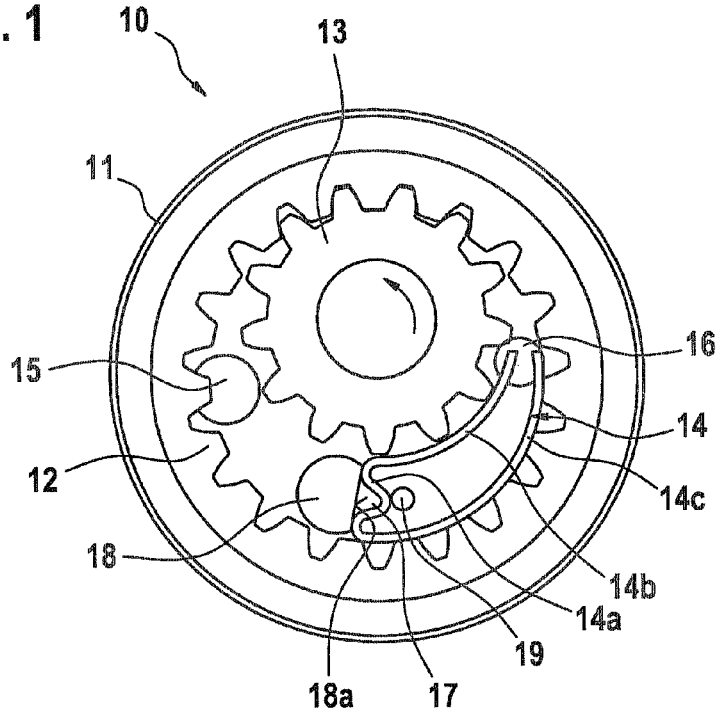
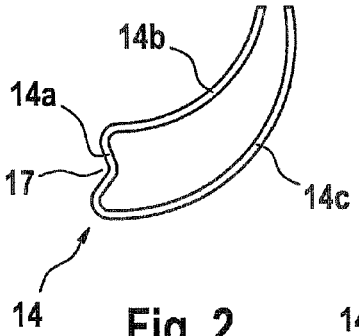
Fig. 2
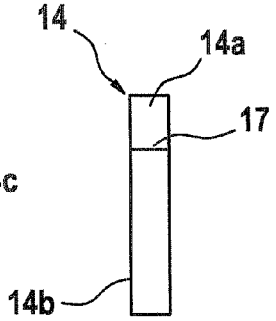
Fig. 3
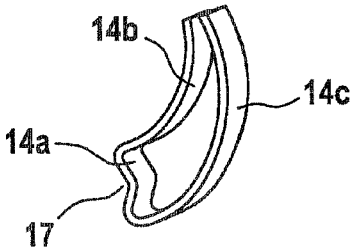
Fig. 4

INTERNAL GEAR PUMP FOR A BRAKE SYSTEM

CROSS-REFERENCE TO RELATED APPLICATION

This application is a 35 USC 371 application of PCT/EP2008/062563 filed on Sep. 19, 2008.

BACKGROUND OF THE INVENTION

1. Field of the Invention

The invention is based on an internal gear pump for a brake system of the kind used particularly in the hydraulic system of vehicle brake systems.

2. Description of the Prior Art

An internal gear pump which can generate a suitably high pressure level of the fluid is already disclosed in German Patent Disclosure DE 196 13 833 B4. Here, the fluid is pumped in the usual way from the suction side to the compression side of the internal gear pump because a filler piece, tapering toward the compression side, is disposed in a crescent-shaped annular chamber of the pump, between the ring gear and the pinion, and is braced by one end axially against the fluid pressure on the compression side at a stop face. The filler piece rests with its curved inner and outer circumferential surface on the pinion and ring gear, respectively, with radial sealing at a plurality of tooth tips. Since the fluid volumes entrained by the sealed-off tooth gaps of the gear wheels that are rotating in the same direction are united at the tapered end of the filler piece, the desired high pressure level results in this region of the pump. To achieve the most effective possible sealing off of the tooth gaps in the region of the tooth tips, the filler piece is assembled from a segment holder, forming the base part, and a sealing segment, braced movably on the segment holder, and the circumferential surface of the segment holder rests on the covered tooth tips of the pinion, and the opposed circumferential surface of the sealing segment rests on the covered tooth tips of the ring gear. Between the segment holder and the sealing segment, a leaf spring arrangement with three leaf springs is also braced, by means of which the segment holder and sealing segment are forced apart and are thus subject to a spring load at the covered tooth tips. In addition, under suitable operating conditions, the segment holder and sealing segment are forced apart via a fluid pressure corresponding to approximately half the operating pressure, since an interstice between the segment holder and the sealing element, which is partitioned off by elastic sealing rollers of an elastomer or polymer material, communicates fluidically through recesses with a pressure buildup region of the ring gear. The sealing rollers engage an associated groove, and during the shifting of the sealing element, they must each be held in their sealing position by a respective one of the three leaf springs. Thus the sealing between the covered tooth tips and the circumferential side, cooperating with them, of the segment holder and sealing element automatically remains effective as the pressure level of the pump rises from an increase in the contact pressure. The individual parts of the filler piece, however, must be manufactured with high precision in order to ensure perfect function of the internal gear pump over an appropriate length of service.

ADVANTAGES AND SUMMARY OF THE INVENTION

The internal gear pump of the invention has the advantage over the prior art that it can be designed structurally substantially more simply, and as a result can be produced more economically and is easier to assembly. Slight tolerances in the radial direction are automatically compensated for by resilient adaptation of the circumferential wall. A structural simplification from a reduction in the number of parts is already obtained if one of the circumferential walls resting on the tooth tips moreover has an invariable curvature that is adapted to the tip circle of the associated gear wheel, and only the other circumferential wall is embodied as radially resilient and thus spring-elastically bendable over its length. In that case, however, the overall filler piece must be braced radially in a shifting-movable manner on the pump housing, so that the reaction forces of the spring forces, acting on only one circumferential side, can also lead to a sealing contact of the fixed circumferential wall with the tooth tips that it covers.

It is especially advantageous that both circumferential sides of the filler piece are formed by a radially resilient circumferential wall. As a result, radial movability of the entire filler piece is no longer necessary, since both circumferential walls, with adapted bending deformation, can rest sealingly on the tooth tips covered by them of the associated toothing.

An especially compact design of the filler piece in its direction of longitudinal extent becomes possible in that each radially resilient circumferential wall of the filler piece extends over the entire length of the associated circumferential side.

Preferably, the filler piece includes a hollow chamber, which is defined by one or both of the radially resilient circumferential walls of the filler piece and communicates fluidically with a pressure region of the internal gear pump. As a result, the radially resilient circumferential walls of the filler piece are forced apart, beyond the radial spring loading, by the hydraulic operating pressure and are put in a contact position on the tooth tips that corresponds to the tip circle diameter of the pinion and ring gear. The radial contact pressure of the circumferential wall or walls is also adapted automatically in proportion to the rising operating pressure of the internal gear pump and is thus suitably compensated for. Thus the radial spring prestressing of the circumferential wall or walls can be selected to be moderate, to avoid excessive friction losses in the internal gear pump.

An especially simple and lightweight mode of construction of the filler piece is obtained if both radially resilient circumferential walls, on the braced end of the filler piece, are connected to one another via a supporting wall, from which they protrude freely as legs. Thus the filler piece includes only three wall regions adjoining one another, and the ends of the freely projecting legs define the overflow opening toward the compression side of the internal gear pump. The supporting wall can preferably be embodied in one piece with the two circumferential walls and can comprise pre-bent longitudinal segments of a leaf spring of spring steel. Between the free ends of the circumferential walls, a spacing may advantageously be present, so that the inside cross section between the free ends of the circumferential walls forms the overflow opening for the fluid from the pressure region of the pump housing.

To make improved sealing of the filler piece, provided with the hollow chamber subjected to pressure, from the low-pressure region of the gear pump possible, the supporting wall of the filler piece may be provided with a central indentation, whose toggle-leverlike course, upon a reduction of the indentation, is extended via the fluid pressure in the interior of the filler piece, leading to a corresponding spreading apart of the circumferential walls, utilizing the toggle lever effect. However, the occurrence of the toggle lever effect has the prerequisite that the supporting wall of the filler piece be braced in the transition region from the central indentation of the supporting wall to the circumferential walls.

Advantageously, the supporting wall is braced by means of a round stop face, which protrudes with a portion of its cross section into the indentation. The round stop face can expediently be the cylindrical circumferential face of a bolt that transversely penetrates the pump housing. The engagement of the partial cross section with the hollow cross section of the indentation simultaneously produces radial bracing of the supporting wall in both directions.

To create more-favorable lever ratios at the supporting wall, however, the stop face may be a plane face which can be formed in particular by a flattened circumferential side of a round bolt that transversely penetrates the pump housing. At the plane stop face, an increased supporting spacing results, since the supporting wall rests only with its humplike curved transition regions from the central indentation of the supporting wall to the circumferential walls of the filler piece. Thus already at a low operating pressure of the fluid, the supporting wall becomes bent backward into its more-stretched-out spread position. Moreover, a greater radial stretching impetus can be generated, since the possible deformation path of the supporting wall is greater than in the case of bracing that engages the hollow cross section of the indentation. For more-extensive positional securing of the filler piece, a retention device structurally connected to the housing can advantageously be provided, by which the filler piece is braced on the inside facing away from the stop face.

Advantageous embodiments of the invention are shown in the drawings and will be described below. In the drawings, the same reference numerals identify components and elements that perform the same or analogous functions.

BRIEF DESCRIPTION OF THE DRAWINGS

The invention will be described in further detail below in conjunction with the accompanying drawings, in which:

FIG. 1 shows the interior of an internal gear pump with a filler piece arrangement, in a side view;

FIG. 2 shows the filler piece of the internal gear pump separately in a side view;

FIG. 3 shows the filler piece of the internal gear pump separately in a circumferential view;

FIG. 4 shows the filler piece of the internal gear pump separately in a perspective oblique view.

DESCRIPTION OF THE PREFERRED EMBODIMENTS

Figure 5:
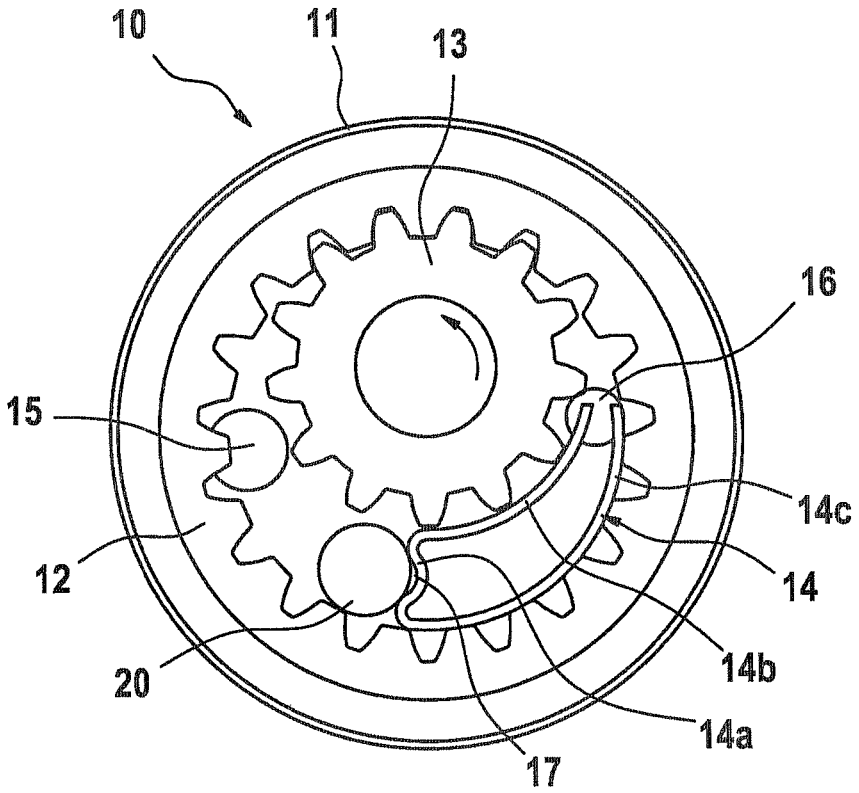
FIG. 5 shows the interior of a variant of the internal gear pump in a side view, with a modified filler piece arrangement.

An internal gear pump 10, shown in FIG. 1, for a hydraulic system of a brake system includes as its main components a ring gear 12 with internal toothing, supported rotatably in a slide bearing of a pump housing 11, with the internal toothing of which ring gear a corresponding opposite toothing of a pinion 13, rotatably supported eccentrically to the ring gear 12 in the pump housing 11, meshes. The internal toothing of the ring gear 12 has nineteen teeth, for example, and the outer toothing of the pinion 13 has thirteen teeth. In the lower right quadrants, the tip circles of the ring gear 12 and pinion 13 form a crescent-shaped pump chamber, in which a crescent-shaped filler piece 14 is disposed that is essentially adapted to the circumferential contour of the pump chamber. The filler piece 14 has the task of sealing off the tooth gaps covered by it, which are axially sealed off on both sides by the face ends of the pump housing 11 and pressure plates disposed thereon, by means of two-dimensional contact with the tooth tips in the region of their tip circle.

If with the tooth tips sealed off, the pinion 13 is rotated clockwise, as indicated by a curved arrow, for instance by means of an electric motor, then the ring gear 12 is rotated with it in the same direction because of the toothing engagement. In the process, the hydraulic fluid in the internal gear pump 10 in the tooth gaps of the ring gear 12 and pinion 13 is pumped from the low-pressure region to the high-pressure region of the internal gear pump 10. The low-pressure region is located in the left half of the pump housing 11, in which a large inflow opening 15 is disposed, and the high-pressure region is located in the right half of the pump housing 11, in which the correspondingly smaller outflow opening 16 can be seen. The pressure increase in the hydraulic fluid occurs from the uniting of the fluid volumes, entrained in the tooth gaps by the sets of teeth, on the tapered end of the filler piece 14 in conjunction with the overflow blocking between the low-pressure region and the high-pressure region of the internal gear pump 10 by means of the filler piece 14. Thus the quality of sealing between the filler piece 14 and the tooth tips covered by it is of decisive significance for the pressure level of the fluid that is to be built up in the hydraulic system by the internal gear pump 10.

As can be seen clearly in conjunction with the individual views in FIGS. 2, 3 and 4, the filler piece 14 comprises a one-piece leaf spring, broken down into three sections, of spring steel with a constant, flat parallel cross section. As shown in the individual views, the filler piece 14 is pre-bent with a crescent-shaped circumferential contour and thus includes a supporting wall 14*a* as its base part, an inner circumferential wall 14*b*, and an outer circumferential wall 14*c*. The curvature of the inner circumferential wall 14*b* over its length is adapted approximately to the tip circle of the pinion 13, and the curvature of the outer circumferential wall 14*c* is adapted over its length approximately to the tip circle of the inner toothing of the ring gear 12; the filler piece 14 is shorter on its inside circumference than on its outside circumference. In the exemplary embodiment shown, three tooth tips of the outer toothing of the pinion 13 and five tooth tips of the inner toothing of the ring gear 12 are simultaneously covered by the filler piece 14. The radially resilient circumferential walls 14*b* and 14*c* connected via the supporting wall 14*a* merge, with a bend of approximately 90°, with the supporting wall 14*a* and protrude freely from the supporting wall 14*a*, resulting in two longitudinal segments, forming an obtuse angle, of the supporting wall 14*a* which are connected to one another via an oppositely curved middle lengthwise region of the supporting wall 14*a*. Thus the supporting wall 14*a* is provided with an indentation 17 in its middle region. Before installation, the two circumferential walls 14*b* and 14*c* are spread apart farther, so that upon insertion they become compressed between the sets of teeth of the ring gear 12 and pinion 13. As a result of this forcing, it is ensured that the circumferential walls 14*b* and 14*c*, by their resilient restoring forces, will conform fully to the associated tooth tips.

So that the filler piece 14 will be held in the intended installed position, it rests with humplike end regions of its supporting wall 14*a* on a plane, radially extending stop face 18*a*. This stop face 18*a* is formed by a flattened right-hand circumferential side of a stop bolt 18 structurally connected to the housing. The result is accordingly axial bracing of the filler piece 14 relative to the suction side, that is, the low-pressure region, of the internal gear pump 10. In the opposite direction, the filler piece 14 is braced via the supporting wall 14*a* on a retention bolt 19, which is structurally connected to the housing and rests on the convex circumferential side centrally on the supporting wall 14*a*. Alternatively, instead of the retention bolt 19, raised points could project from the axial pressure plates of the internal gear pump 10 and, as retention means, protrude near the supporting wall 14*a* into the hollow cross section of the filler piece 14.

The filler piece 14 is pre-bent in such a way that its resilient circumferential walls 14*b* and 14*c*, after insertion between the ring gear 12 and pinion 13, rest with adequate radial prestressing force on the tooth tips of the toothing associated with them. Between the free ends of the circumferential walls 14*b* and 14*c*, a gap remains, which represents an overflow opening toward the compression side or high-pressure region of the internal gear pump 10. Thus the entire hollow chamber of the filler piece 14, outlined by the supporting wall 14*a*, circumferential wall 14*b* and circumferential wall 14*c*, and bounded axially by housing walls or their pressure plates, fills with the hydraulic fluid and is at the pressure prevailing in the high-pressure region. As a result, the circumferential walls 14*a* and 14*b* are also forced apart, so that their contact pressure that is definitive for the sealing action at the tooth tips is automatically increased as a function of pressure. At a very high pressure level in the hollow chamber of the filler piece 14, the supporting wall 14*a* is additionally deformed, whereupon the curved middle region of the supporting wall 14*a* is bent open and as a result moved toward the plane stop face 18*a*, and the supporting wall 14*a* is flattened accordingly. As a result of this flattening, the angle between the longitudinal regions of the supporting wall that define the indentation 17 becomes more obtuse, which leads to a lengthening of the supporting wall 14*a*. The lengthening forces transmitted as a result additionally force the circumferential walls 14*b* and 14*c* apart and, for the tooth tips located close to the supporting wall 14*a*, they assure better sealing off from the low-pressure region of the internal gear pump 10.

The embodiment of the internal gear pump 10 shown in FIG. 5 differs from that described only in the manner of bracing of the filler piece 14 in the region of the supporting wall 14*a*. Instead of a flattened stop bolt 18, a stop bolt 20 of cylindrical cross section is provided, which with a partial cross section engages the indentation 17 in the supporting wall 14*a*. As a result, in addition to the axial bracing, a certain radial bracing of the supporting wall 14*a* on the stop bolt 20 also results. At high pressures of the fluid in the hollow chamber of the filler piece 14, the stretched position shown of the supporting wall 14*a* results, in which position the supporting wall rests virtually over its entire surface on the circumference of the stop bolt 20 and introduces maximum spreading forces into the circumferential portions, near the supporting wall, of the circumferential walls 14*a* and 14*b*. Thus reliable sealing off of the filler piece 14 from the suction side of the internal gear pump 10 is ensured. Also in this embodiment, as needed for bracing of the supporting wall 14*a* on the convex side, that is, toward the compression side, a retention bolt transversely penetrating the hollow chamber or bracing via protrusions, protruding laterally into the hollow chamber, of the axial side walls of the pump housing 11 or of pressure plates protruding from it are provided.

The foregoing relates to the preferred exemplary embodiments of the invention, it being understood that other variants and embodiments thereof are possible within the spirit and scope of the invention, the latter being defined by the appended claims.

The invention claimed is:

1. An internal gear pump for a brake system, in the pump housing of which an internally toothed ring gear and a pinion, meshing with toothing of the ring gear, are rotatably supported about parallel axes, as a result of which their sets of teeth define an annular chamber, which tapers in approximately crescent-shaped fashion and in which a filler piece braced toward the suction side of the pump is disposed, the filler piece having two circumferential sides, curved in accordance with a tip circumference of the ring gear toothing or the pinion toothing, which rest sealingly, under a spring load, on a plurality of tooth tips covered by the circumferential sides, wherein one of the two circumferential sides of the filler piece is formed by a radially resilient circumferential wall, which as a consequence of their sagging based on intrinsic spring force conforms to the tooth tips, covered by the one of the circumferential sides, of the pinion or ring gear;

wherein both circumferential sides of the filler piece are formed by a radially resilient circumferential wall, as a result of which one circumferential wall conforms resiliently to the tooth tips of the pinion which are covered, and the other circumferential wall conforms resiliently to the tooth tips of the ring gear which are covered;

the radially resilient circumferential walls on a braced end of the filler piece are connected to one another via a supporting wall, from which they protrude freely in the form of legs;

the two circumferential walls and the supporting wall are formed by pre-bent longitudinal segments of a one-piece leaf spring of spring steel; and wherein a middle leg of the filler piece, which forms the supporting wall, is provided with a central indentation.

2. The internal gear pump as defined by claim 1, wherein the supporting wall of the filler piece is braced on the pump housing via a round stop face of a stop bolt, which protrudes with a portion of its cross section into the indentation of the supporting wall.

3. The internal gear pump as defined by claim 2, wherein the circumferential wall extends over an entire length of an associated circumferential side of the filler piece.

4. The internal gear pump as defined by claim 3, wherein the circumferential wall is a boundary wall of a hollow chamber of the filler piece, which chamber communicates fluidically with a pressure region of the internal gear pump.

5. The internal gear pump as defined by claim 2, wherein the circumferential wall is a boundary wall of a hollow chamber of the filler piece, which chamber communicates fluidically with a pressure region of the internal gear pump.

6. The internal gear pump as defined by claim 1, wherein the supporting wall of the filler piece is braced in a manner fixed to the housing with convex regions, adjoining the indentation, on a plane stop face.

7. The internal gear pump as defined by claim 1, wherein a retention device cooperating with the supporting wall is disposed on a convex side of the indentation.

8. The internal gear pump as defined by claim 1, wherein the circumferential wall extends over an entire length of an associated circumferential side of the filler piece.

9. The internal gear pump as defined by claim 8, wherein the circumferential wall is a boundary wall of a hollow chamber of the filler piece, which chamber communicates fluidically with a pressure region of the internal gear pump.

10. The internal gear pump as defined by claim 1, wherein the circumferential wall is a boundary wall of a hollow chamber of the filler piece, which chamber communicates fluidically with a pressure region of the internal gear pump.

* * * * *

UNITED STATES PATENT AND TRADEMARK OFFICE

CERTIFICATE OF CORRECTION

PATENT NO. : 8,475,150 B2
APPLICATION NO. : 12/738459
DATED : July 2, 2013
INVENTOR(S) : Kaeferstein et al.

It is certified that error appears in the above-identified patent and that said Letters Patent is hereby corrected as shown below:

On the title page, item (75), replace "Moeckmuchl" with --Moeckmuehl--.

Signed and Sealed this
Twenty-eighth Day of January, 2014

Michelle K. Lee

Michelle K. Lee
*Deputy Director of the United States Patent and Trademark Office*